United States Patent [19]

Takeda et al.

[11] Patent Number: 4,722,880

[45] Date of Patent: Feb. 2, 1988

[54] PHOTOCONDUCTOR HAVING AMORPHOUS SILICON HYDRIDE

[75] Inventors: Etsuya Takeda; Eiichiro Tanaka; Shinji Fujiwara, all of Osaka, Japan

[73] Assignee: Matsushita Electric Industrial Co., Ltd., Japan

[21] Appl. No.: 783,233

[22] Filed: Oct. 2, 1985

[30] Foreign Application Priority Data

Oct. 3, 1984 [JP] Japan ..... 59-207476

[51] Int. Cl.[4] ..... G03G 5/085

[52] U.S. Cl. ..... 430/84; 430/95; 430/65; 430/128

[58] Field of Search ..... 430/84, 95, 65, 128

[56] References Cited

U.S. PATENT DOCUMENTS

| | | | |
|---|---|---|---|
| 4,217,374 | 8/1980 | Ovshinsky et al. | 430/84 |
| 4,265,991 | 5/1981 | Hirai et al. | 430/64 |
| 4,414,319 | 11/1983 | Shirai et al. | 430/84 |

*Primary Examiner*—John L. Goodrow

*Attorney, Agent, or Firm*—Lowe, Price, LeBlanc, Becker & Shur

[57] ABSTRACT

A photoconductor which comprises, on a conductive substrate, a photoconductive layer of amorphous silicon hydride to which a first impurity consisting essentially of an element of Group Va or Group VIa of the Periodic Table is added. The contents of the first impurity and hydrogen in the amorphous silicon hydride layer vary in section from one side toward the other side of said layer.

15 Claims, 5 Drawing Figures

PHOTOCONDUCTOR HAVING AMORPHOUS SILICON HYDRIDE

BACKGROUND OF THE INVENTION

1. Field of the Invention

This invention relates to photoconductors which have a photoconductive layer composed predominantly of amorphous silicon hydride and can be effectively utilized as one-dimensional or two-dimensional image sensors or electrophotographic photosensitive materials.

2. Description of the Prior Art

Photoconductors, which have an amorphous silicon hydride layer on a conductive substrate, have been recently developed and are now being studied because of the absence of public nuisance, their high photosensitivity, good resistance to heat and high spectrophotosensitivity over a whole range of visible light. These photoconductors have wide utility of the field of image sensors such as pickup tube targets and solid image pickup elements, or electrophotographic photosensitive materials.

For the formation of the photoconductive layer of amorphous silicon hydride on a substrate, several methods, are known including a plasma CVD method in which silane gas is decomposed in plasma, a reactive sputtering method in which silicon is provided as a target and hydrogen gas is introduced into the sputtering atmosphere along with an inert gas, and an ion plating method in which silicon vapor is reacted with hydrogen in hydrogen plasma.

The photoconductors, which are obtained by the plasma CVD and ion-plating methods, have the drawback that the resulting photoconductive layers are so small in resistance that the dark current becomes too large for use as image sensors or electrophotographic photosensitive materials. To avoid this, a blocking layer is provided between the photoconductive layer and the conductive substrate, or oxygen or nitrogen is introduced into the photoconductive layer in order to make a high resistant layer when the photoconductive layer of amorphous silicon hydride is formed by the plasma CVD method. Alternatively, as taught in Japanese Laid-open Patent Application No. 56-16434, when a small amount of selenium is added to amorphous silicon hydride on performing the plasma CVD method, the dark specific resistance increases up to about $10^{11}$ ohm-cm. However, this dark specific resistance value is not sufficient for image devices such as electrophotographic photosensitive materials.

In contrast, when the reactive sputtering method is used to form an amorphous silicon hydride layer, the resulting photoconductive layer has a resistance higher than the amorphous silicon hydride layer formed by the plasma CVD method. Although such a layer would be expected to be useful as an electrophotographic photosensitive material, it is disadvantageous in view of its poor photosensitivity. Accordingly, the photoconductive layer formed by the reactive sputtering method has not been studied actively.

We proposed formation of a photoconductive layer by the reactive sputtering method in which a chalcogen element was added to the amorphous silicon hydride layer in small amounts. This type of photoconductive layer had a specific resistance higher by about two orders of magnitude than the photoconductive layer of amorphous silicon hydride formed by the plasma CVD method, i.e. the specific resistance was about $10^{13}$ ohm-cm. Although the amorphous silicon hydride layer formed by the ordinary reactive sputtering method was disadvantageously low in photosensitivity, the chalcogen element-containing layer had a photosensitivity substantially equal to the photosensitivity attained by the plasma CVD method. For instance, when selenium was introduced into the photoconductive layer by the reactive sputtering method, the dark specific resistance slightly lowered with a specific resistance of $10^{13}$ ohm-cm. Thus, the layer had a high enough resistance for use in image devices and had high photosensitivity. However, in order to further improve the photoconductors, it is necessary to impart a high withstand-voltage to the photoconductor for use in image devices while keeping the high photosensitivity.

If the withstand-voltage is low, it is necessary to make the photosensitive layer thick when used as an electrophotographic photosensitive material so that the surface potential necessary for the electrophotographic process is ensured. This will present a problem from the standpoint of production cost. The photoconductive layer having a low withstand voltage is also disadvantageous in that white defects are liable to form upon application of corona voltage. Accordingly, further studies have been made to provide amorphous silicon hydride-base photoconductors which have a withstandvoltage as high as possible.

SUMMARY OF THE INVENTION

It is therefore an object of the present invention to provide an amorphous silicon hydride-base photoconductor material which has an improved withstand voltage and good photosensitivity.

It is another object of the invention to provide an amorphous silicon hydride-base photoconductor which exhibits good corona resistance when applied as an electrophotographic photosensitive material and which has a high charge potential per unit thickness whereby the photoconductor can be made thin and have the same surface potential.

It is a further object of the invention to provide a photoconductor which is more inexpensive than known counterparts.

The above objects can be achieved, according to the invention, by a photoconductor of the type which comprises, on a conductive substrate, a photoconductive layer of amorphous silicon hydride to which an impurity consisting essentially of an element of Group Va or Group VIA of the Periodic Table is added. The present invention is characterized in that the hydrogen and the impurity element in the photoconductive layer have concentrations varying, in section, from one side toward the other side of the layer, The one side may be either an interface between the layer and the substrate or the outer surface of the layer. The photoconductive layer may consist of two sub-layers, one of which comprises higher concentrations of hydrogen and the impurity element. The other sub-layer may have lower gradient concentrations of hydrogen and the impurity element than the one sub-layer or may be free of any impurity element in which case the hydrogen content should be lower than the one sub-layer.

DETAILED DESCRIPTION AND EMBODIMENTS OF THE INVENTION

As is known in the art, the elements of Group Va of the Periodic Table such as, for example, N, P, As, Sb and the like, serve as a donative impurity in a photoconductive layer of amorphous silicon hydride. We found that the elements of Group VIa, e.g. O, S, Se, Te and the like, also acted as the donative impurity. These Va and VIa elements are hereinafter called "first impurity".

When the first impurity is added to the photoconductive layer in such a way that its concentration is higher at or in the vicinity of either side of the layer, i.e. an interface between a conductive substrate and the photoconductive layer or an opposite surface, than in the other portion. By this, the more concentrated portion results in a greater tendency toward the n type. Thus, it is believed that when the first impurity is added at a concentration varying in the photoconductive layer, an n-i type diode is provided. In addition, when a small amount of the first impurity is incorporated in the i type layer, the mobility of electrons increases, so that the operation voltage lowers with a high attenuation speed of light when the photoconductor is used as an electrophotographic photosensitive material.

In the practice of the invention, it is important that the first impurity and hydrogen be added as more concentrated at either side of the photoconductive layer. It is preferred that the first impurity has an atomic ratio to Si of from $10^{-5}$ to $5\times10^{-2}$ at the more concentrated side.

At the more concentrated side of the first impurity, hydrogen should be contained in amounts higher than at the other portion, by which the forbidden energy band becomes wider than in the other portion and thus the hydrogen-enriched portion serves as a hole-blocking layer. As a result, the photoconductive layer can withstand higher voltage. The content of hydrogen in the enriched portion is preferred to be higher by 0.1 atomic% or greater than in the portion where the content of the first impurity is smaller.

Figure 1A:
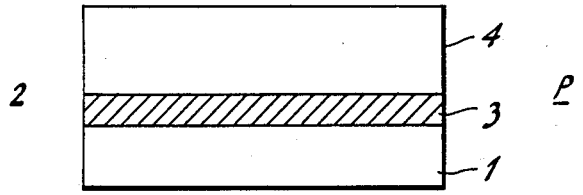
FIGS. 1*a* and 1*b* are schematic side views of photoconductors according to the present invention.
Figure 1B:
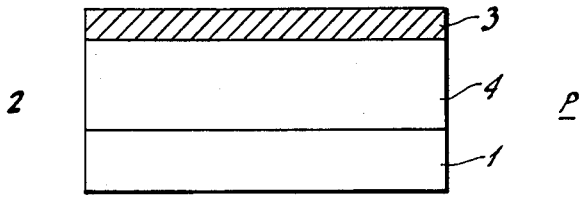

Reference is now made to the accompanying drawings and particularly to FIGS. 1*a* and 1*b*, in which like reference numerals indicate like parts or members. In the figures, there is shown a photoconductor P which includes a conductive substrate 1 and a photoconductive layer 2 formed on the substrate 1. The substrate 1 may be made of any metals such as aluminum, stainless steel and the like and in the form of a sheet, plate, or the like. The photoconductive layer 2 is made of amorphous silicon hydride and a first impurity and includes a shaded sub-layer 3, which has higher concentrations of the first impurity and hydrogen than the other sub-layer 4. In FIG. 1*a*, the shaded sub-layer 3 which has higher concentrations, is in contact with the substrate 1. On the other hand, FIG. 1*b* shows the case where the shaded sub-layer 3 is provided as the surface layer of the amorphous silicon hydride layer 2. In this arrangement, the photoconductive layer has the structure of an n-i type diode which has different forbidden band widths.

In the above figures, the photoconductive layer 2 is illustrated as consisting of two separate sub-layers, but may be one layer in which the first impurity and hydrogen are added in continuously varying concentrations from one side toward the other of the photoconductive layer. Although the amorphous silicon hydride layer 4 which contains the first impurity throughout the layer, has the advantage that the mobility of electrons becomes great, the case where the sub-layer 4 is free of any first impurity is also within the scope of the present invention.

As a matter of course, the concentration distributions of the first impurity and hydrogen may not necessarily coincide with each other.

In FIGS. 1*a* and 1*b*, the sub-layer 3 in which the first impurity is contained in a higher concentration, serves as a hole blocking layer.

Figure 2A:
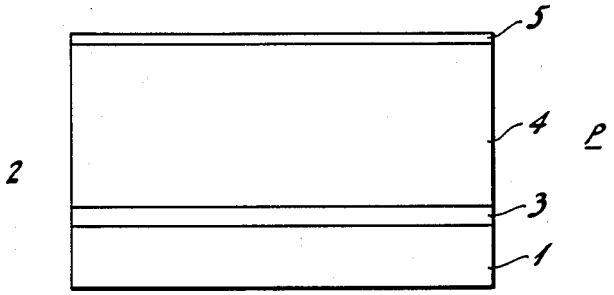
FIGS. 2*a* through 2*b* are schematic side views of photoconductors according to further embodiments of the invention.
Figure 2B:
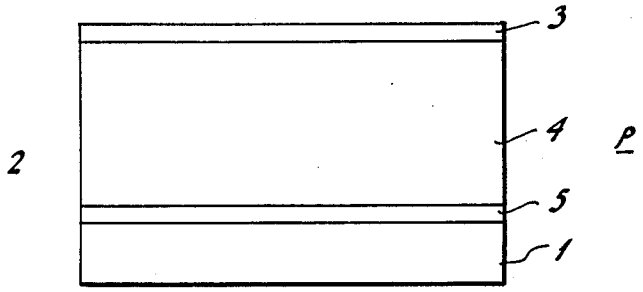

FIGS. 2*a* and 2*b* show further embodiments of the invention, in which an electron-blocking layer 5 is formed on the sub-layer 4 in FIG. 2*a* and on the conductive substrate 1 in FIG. 2*b*, by which an n-i-p type diode is provided and can withstand a higher voltage. The electron-blocking layer may be a p type amorphous silicon hydride layer, an amorphous silicon carbide, an insulative layer such as a silicon nitride layer, silicon oxide layer, aluminum oxide layer or the like.

In order to further improve the withstand-voltage properties, a second acceptor impurity is added to the sublayer 4 where the first impurity has a reduced or no content. The second impurity is, for example, an element of Group IIIa such as B, Al, Ga, In or the like or an element of Group IIb such as Zn, Cd, Hg or the like. The addition of the second acceptor impurity to the photoconductive layer renders the layer more intrinsic, so that the withstand voltage properties are further improved. The amount of the second impurity is generally in the range of 1 to 1000 ppm.

The photoconductor of the present invention may be made according to a plasma CVD method, ion plating method or reactive sputtering method. The withstand-voltage properties can be improved by the formation of the photoconductive layer by any method. However, better withstand voltage properties are conveniently obtained using the reactive sputtering method. The particular process of the reactive sputtering is described in detail in the following examples, which should not be construed as limiting the present invention.

EXAMPLE 1

This example illustrates a photoconductor shown in FIG. 1(*a*).

Single crystals of Si into which Se was ion-implanted were placed in a magnetron sputtering apparatus, followed by evacuation to $2\times10^{-6}$ Torr. While an aluminum plate 1 was heated to and maintained at 250° C., Ar, $H_2$ and 1 vol. % $H_2Se$-containing $H_2$ were charged into the apparatus such that partial pressure were, respectively, $4.5\times10^{-3}$ Torr., $5\times10^{-4}$ Torr. and $5\times10^{-4}$ Torr. The sputtering was effected at a discharge power of 100 W, thereby forming an Se-containing amorphous silicon hydride layer 3 with a thickness of 0.2 μm on the substrate 1. Thereafter, the $H_2Se$-containing $H_2$ was stopped charging and then a discharge power of 200 W was applied to form an a 3 μm thick amorphous silicon hydride layer 4. In this manner, the layer 3 in which Se was contained in larger amounts was formed on the conductive Al substrate. Subsequently, a 1 mm square transparent electrode was formed by sputtering on the layer 4 in a thickness of 1000 angstrom. The resulting photoconductor was thermally treated in vacuum at 300° C. for 20 minutes. The specific resistance prior to the thermal treatment was found to be $1\times10^{13}$ ohm-cm and $5\times10^{13}$ ohm-cm after the thermal treatment. When −5 volts were applied to the transparent electrode, the quantum efficiency was found to be as high as 0.98, prior to and after the thermal treatment, in the visible light range of 400 to 600 nm.

The thus obtained photoconductor film was formed on a charge coupled device (CCD) as an overlayed solid pickup element. The resultant solid pickup device has good characteristics with regard to dark current, photosensitivity, photoresponse and resolution.

The above procedure was repeated usins S and Te instead of Se, with similar results.

EXAMPLE 2

A polycrystalline Si target with a diameter of 6 inches was provided and a Se-deposited film was formed around the target. This target was placed in position within a magnetron sputtering apparatus. Thereafter, an A1 substrate was heated to and maintained at 250° C., followed by evacuation to $2\times10^{-6}$ Torr, or below. Ar and $H_2$ were charged into the apparatus to $4\times10^{-3}$ Torr, and $1\times10^{-3}$ Torr., respectively, followed by application of a discharge power of 100 W to form a first Se-containing amorphous silicon hydride layer in a thickness of 0.2 μm. Subsequently, the pressures of Ar and $H_2$ were changed to $4.5\times10^{-3}$ Torr. and $5\times10^{-4}$ Torr., respectively, followed by forming a second Se-containing amorphous silicon hydride layer in a thickness of 6 to 7 μm by a discharge power of 300 W.

Figure 3:
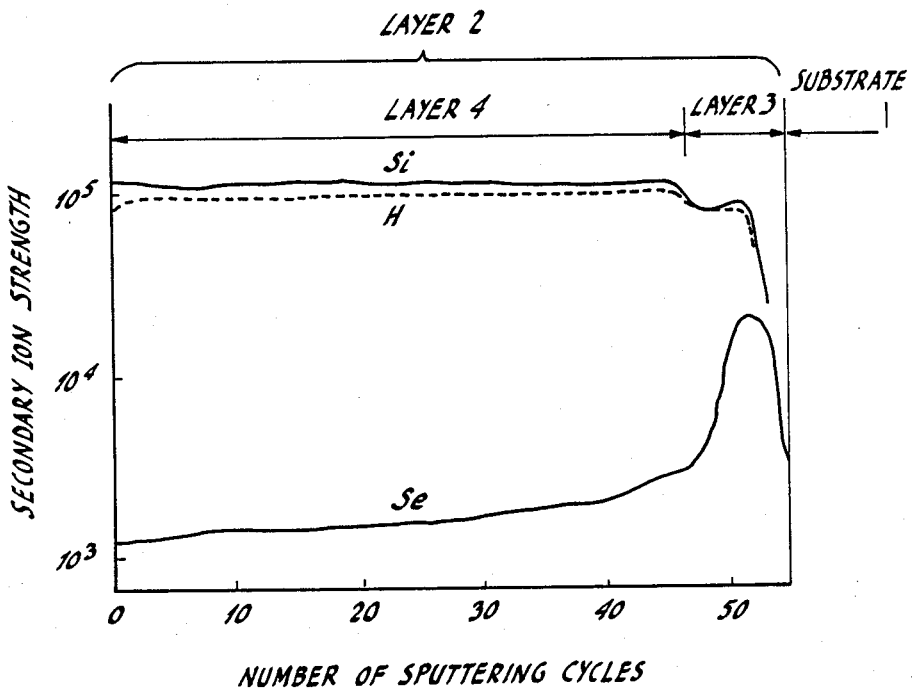
FIG. 3 is a view of distribution of Se, H and Si in an amorphous silicon hydride layer obtained in Example 2.

The resultant amorphous silicon hydride layer was subjected to an SIMS analysis to determine a compositional distribution of the Si, H and Se elements along the section of the layer. The results are shown in FIG. 3. The signal for H in the SIMS analysis is smaller in the layer 3 than in the layer 4, and is considered due to the the influence of charging-up. According to the infrared absorption analysis, the hydrogen content in the layer 3 was found to be higher than in the layer 4. In addition, the ratio of H to Si was higher in the layer 3 than in the layer 4. The ratio of Se to Si in the layer 3 was determined by the atomic-absorption spectroscopy with a result of $2\times10^{-3}$. The average ratio of Se to Si in the layer 2 was found to be $5\times10^{-5}$.

The amorphous silicon hydride layer 3 in contact with the A1 substrate 1 has thus higher contents of Se and H. In the layer 4, the contents of Se and H decreased toward the outer surface. Thus, the layer 3 serves as a hole-blocking layer having a wide forbidden band and can withstand high voltage.

When the amorphous silicon layer 2 was charged by means of a corotron, the charged voltage was −350 volts with a half-attenuation time of 15 seconds in the dark. Irradiation of the layer by means of a tungsten lamp at 3 luxes resulted in a surface potential of zero within 1 second.

EXAMPLE 3

The photoconductor obtained in Example 2 was further treated so that an electron-blocking layer, as shown in FIG. 2*a*, was formed on the amorphous silicon hydride layer 2.

More specifically, the Al substrate 1 was maintained at 150° C., and Ar and $N_2$ were charged into a magnetron sputtering apparatus, from which the Se tablets had been removed, to pressures of $1\times10^{-3}$ Torr. and $2\times10^{-3}$ Torr. respectively. A discharge power of 400 W was applied, thereby forming a 600 angetrom thick SiNx layer 5 on the amorphous silicon hydride layer 4.

The SiNx layer 5 was analyzed by ESCA, revealing that the layer was composed substantially of a stoichiometric ratio between Si and N, or SiNx was very close to $Si_3N_4$.

The resulting electrophotographic photosensitive material had an initial charge potential of −420 volts, a half-attenuation time of 40 seconds in the dark with a residual potential of −5 volts.

Since the SiNx layer serving as an electron-blocking layer was formed on the surface of the photoconductive layer, the photoconductor behaved as an n-i-p-like diode and had a high resistance under reverse-biased conditions. Presumably, this is the reason why the charge potential increases along with an increasing half-attenuation time.

When the above procedure was repeated using, instead of the SiNx layer, a p-type amorphous silicon hydride, amorphous SixC1-x layer or SiOx layer, similar results were obtained.

EXAMPLE 4

The electrophotographic photosensitive material obtained in Example 3 and having the SiNx surface layer 5 was thermally treated in vacuum at 250 to 350° C. for 5 to 100 minutes. The initial charge potential reached −500 volts. By the thermal treatment, the photosensitivity did not deteriorate.

For comparison, the following three electrophotographic photosensitive materials (1) through (3) were made: (1) a material having the same concentrations of H and Se throughout the layer 2; (2) a material in which the concentration of H was higher in the sub-layer 3 than in the sub-layer 4 but the concentration of Se was uniform throughout the layer 2; and (3) a material in which the concentration of Se was higher in the sub-layer 3 than in the sub-layer 4 but the concentration of H was uniform throughout the layer 2. After the thermal treatment as mentioned above, the initial charge potentials of these materials are shown in the following table.

TABLE

| | | | Initial Charge Potential (V) | | |
|---|---|---|---|---|---|
| | H Content | Se Content | Prior to Heat Treatment | After Heat Treatment Under Vacuum | After Heat Treatment In Air |
| Comparison: | | | | | |
| 1 | $H_3 = H_4$(*1) | $S_3 = S_4$(*2) | −156 | −303 | −270 |
| 2 | $H_3 > H_4$ | $S_3 = S_4$ | −220 | −340 | −300 |
| 3 | $H_3 = H_4$ | $S_3 > S_4$ | −250 | −430 | −390 |

TABLE-continued

| | H Content | Se Content | Initial Charge Potential (V) Prior to Heat Treatment | After Heat Treatment Under Vacuum | After Heat Treatment In Air |
|---|---|---|---|---|---|
| Ex. 4 | $H_3 > H_4$ | $S_3 > S_4$ | −420 | −500 | −460 |

(*1)$H_3$, $H_4$: contents of hydrogen in the layers 3, 4, respectively.
(*2)$S_3$, $S_4$: contents of Se in the layers 3, 4, respectively.

As will be seen from the above results, the initial charge potentials significantly increase when the contents of H and Se are simultaneously changed as in the present invention. The heat or thermal treatment in vacuum will be found to be effective in increasing the initial charge potential. When other types of surface layers of SiCx and SiOx were used, the potential characteristic was also improved by the heat treatment in vacuum.

EXAMPLE 5

The samples of the invention and for comparison obtained in Example 4 but prior to the heat treatment, were thermally treated in air at a temperature of from 250° to 400° C. for 5 to 200 minutes, with the results shown in the above table. The initial potentials after the treatment in air were lower than those potentials after the treatment in vacuum. The sample of the invention was superior to the samples for comparison.

EXAMPLE 6

The samples obtained in Example 4 but prior to the heat treatment, were thermally treated in different atmospheres of an inert gas, hydrogen and nitrogen at a temperature of 250° to 400° C. for 5 to 200 minutes. The initial charge potentials of these samples were similar to those potentials attained by the thermal treatment in vacuum.

EXAMPLE 7

This example illustrates a case of FIG. 2*a* where no first impurity is added to the sub-layer 4 in which the hydrogen content is smaller.

A mirror-polished stainless steel plate 1 was placed in an RF magnetron sputtering apparatus, followed by evacuation to a pressure of $1\times10^{-6}$ Torr. The substrate 1 was increased to 210° C. Thereafter, $3.5\times10^{-3}$ Torr. of Ar and $1.5\times10^{-3}$ Torr. of $H_2$ containing 3% of $H_2Se$ were charged into the apparatus, followed by discharging at 800 W, thereby forming a 0.4 μm thick first amorphous silicon hydride layer 3. Next, $4.0\times10^{-}$Torr. of Ar and $1.0\times10^{-3}$ Torr. of $H_2$ free of $H_2Se$ were introduced into the apparatus and applied with a discharge power of 800 W to form a second amorphous silicon hydride 4. Subsequently, $1\times10^{-3}$ Torr, of Ar and $3\times10^{-3}$ Torr. of $N_2$ were introduced into the apparatus and applied with a discharge power of 400 W, thereby forming a 1000 angstrom thick SiNx layer 5. The introduction was stopped and the substrate was increased to 300° C. and maintained for 30 minutes. The apparatus was cooled, from which the resulting electrophotographic photosensitive material was removed and subjected to measurement of a potential characteristic. As a result, the initial potential was found to be −500 volts similar to the electrophotographic photosensitive material of Example 4, but the material of this example could be made within a time as short as about ⅓ of Example 1.

EXAMPLE 8

In Example 7, the partial pressure of hydrogen was changed so that the hydrogen content in the sub-layer 3 was larger than the content in the sub-layer 4. However, the hydrogen content in the layer 2 can be changed by changing the discharge power while keeping a constant partial pressure of hydrogen. When the partial pressure of hydrogen is kept constant, the hydrogen content in the amorphous silicon hydride increases with a decreas of the discharge power.

After the evacuation similar to Example 7, the substrate temperature was maintained at 210° C. Thereafter, $4.0\times10^{-3}$ Torr, of Ar and $1.0\times10^{-3}$ Torr, of $H_2$ containing 3% of $H_2Se$ were introduced into the apparatus and discharged at 550 W, thereby forming a 0.4 μm thick first amorphous silicon hydride layer 3. Then, similar to Example 7, while keeping Ar at the constant pressure, $1.0\times10^{-3}$ Torr, of $H_2$, free of $H_2Se$, was introduced and discharged at 800 W, thereby forming a second amorphous silicon hydride layer. The formation of the SiNx layer and the thermal treatment were carried out in the same manner as in Example 7. The resulting electrophotographic photosensitive material had almost the same characteristic as the material of Example 7.

EXAMPLE 9

This example illustrates a photoconductor of the type shown in FIG. 1(*b*) in which a chalcogen element and an acceptor-type impurity were incorporated in the layer 4 which has a less content of the chalcogen element. When the donative chalcogen and the acceptor impurity are used together, the amorphous silicon hydride layer 4 becomes more intrinsic, leading to a higher resistance and a greater tendency to move electrons and holes.

After evacuation of a magnetron sputtering apparatus, a mirror-polished stainless steel substrate 1 was heated to and maintained at 200° C., followed by introducing $4.0\times10^{-3}$ Torr, of Ar and $5\times10^{-4}$ Torr, of $H_2$ containing 50 ppm of $H_2Se$ into the apparatus. In addition, $5\times10^{-4}$ Torr, of $H_2$ containing 50 ppm of $B_2H_6$ was charged to make a total pressure of $5\times10^{-3}$ Torr. Si single crystals were provided as a target and a 20 μm amorphous silicon hydride 4 was formed on the substrate 1 at a charge power of 400 W.

The charge of $H_2$ containing $B_2H_6$ was stopped. Instead, $2\times10^{-3}$ Torr, of $H_2$ containing $H_2Se$ was introduced into the apparatus and a 1 μm thick amorphous silicon hydride 3 was formed on the layer 4 under a total pressure of $5\times10^{-3}$ Torr. The layer 3 had higher contents of Se and H than the layer 4, and the layer 4 had the Se and B impurities, so that the resulting electrophotographic photosensitive material could be charged either positively or negatively.

EXAMPLE 10

On a glass substrate having a transparent electrode were formed a 0.2 μm thick amorphous silicon hydride layer having higher concentrations of H and Se under the same conditions as with the layer 43 of Example 9 and a 3 μm thick B-doped amorphous silicon hydride having lower concentrations of H and Se under the conditions as with the layer 44 of Example 9. Thereafter, an electron beam landing layer of $Sb_2S_3$ was further formed in a thickness of 1000 angstrom. The resulting element was used as a pickup target with good photosensitivity, resolution and photoresponse.

EXAMPLE 11

The general procedures of Example 1, 7, 8 and 9 were, respectively, repeated using P, which is an element of Group Va, instead of Se. In these examples, $H_2$ gas containing $P_2H_6$ was used instead of $H_2Se$-containing $H_2$ gas. As a result, it was found that Se and P gave substantially the same charge potential.

In the above examples, the reactive sputtering technique was used, but plasma CVD and ion-plating methods may be used to make the photoconductor of the present invention. However, the reactive sputtering is more advantageous in that a high withstand-voltage photoconductor can be obtained and the layer formed by the reactive sputtering has higher hardness and higher adhesion to a substrate, leading to a long-lived photoconductor.

What is claimed is:

1. In a photoconductor which comprises, on a conductive substrate, a photoconductive layer of amorphous silicon hydride including a first impurity consisting essentially of an element of Group Va or Group V1a of the Periodic Table, the improvement in that the contents of said first impurity and hydrogen in the amorphous silicon hydride layer vary, in section, from one side toward the other side and the higher concentrations of both the hydrogen and the first impurity are at the same side of the silicon hydride layer.

2. A photoconductor according to claim 1, wherein the one side is an interface between said layer and said substrate and has higher contents of hydrogen and said first impurity.

3. A photoconductor according to claim 1, wherein the one side in the outer surface of said layer and has higher contents of hydrogen and said first impurity.

4. A photoconductor according to claim 1, wherein the contents of hydrogen and said first impurity vary continuously.

5. A photoconductor according to claim 1, wherein said layer has two sub-layers, one of which has higher contents of said first impurity and hydrogen whereas the other sub-layer has lower contents of said first impurity and hydrogen.

6. A photoconductor according to claim 5, wherein the other sub-layer is free of said first impurity.

7. A photoconductor according to claim 5, wherein the other sub-layer further comprises a second impurity, serving as an acceptor, selected from the group consisting of elements of Groups IIb and IIIa of the Periodic Table whereby said photoconductor is charged either negatively or positively.

8. A photoconductor according to claim 5, wherein hydrogen is contained in the one sub-layer in amounts higher by at least 0.1 atomic % than in the other sub-layer.

9. A photoconductor according to claim 1, wherein said first impurity is a chalcogen element.

10. A photoconductor according to claim 1, wherein the content of said first impurity at a more concentrated side of said layer is from $10^{-5}$ to $5\times10^{-2}$ as expressed by an atomic ratio to Si.

11. A photoconductor according to claim 1, further comprising an electron-blocking layer on the side opposite to the one side, where hydrogen and said first impurity have higher contents.

12. A photoconductor according to claim 11, wherein said electron-blocking layer is an insulative layer.

13. A photoconductor according to claim 12, wherein said electron-blocking layer consists of a member selected from the group consisting of silicon oxide, silicon nitride, silicon carbide, p-type amorphous silicon hydride, and aluminum oxide.

14. A photoconductor according to claim 1, wherein said first impurity is Se.

15. A photoconductor according to claim 1, wherein said photoconductive layer is formed by reactive sputtering.

* * * * *